US008066496B2

(12) United States Patent
Brown

(10) Patent No.: US 8,066,496 B2
(45) Date of Patent: Nov. 29, 2011

(54) RECIPROCATED PUMP SYSTEM FOR USE IN OIL WELLS

(76) Inventor: T. Leon Brown, Amarilla, TX (US)

( * ) Notice: Subject to any disclaimer, the term of this patent is extended or adjusted under 35 U.S.C. 154(b) by 1282 days.

(21) Appl. No.: 11/668,252

(22) Filed: Jan. 29, 2007

(65) Prior Publication Data

US 2008/0135259 A1 Jun. 12, 2008

Related U.S. Application Data

(63) Continuation-in-part of application No. 11/103,067, filed on Apr. 11, 2005, now abandoned.

(51) Int. Cl.
*F04B 43/00* (2006.01)
*E21B 43/00* (2006.01)

(52) U.S. Cl. ..... 417/555.2; 417/435; 166/68.5; 166/105

(58) Field of Classification Search ..... 417/415, 417/555.1, 552, 435, 555.2; 166/68.5, 369, 166/68, 105
See application file for complete search history.

(56) References Cited

U.S. PATENT DOCUMENTS

| | | | | |
|---|---|---|---|---|
| 1,266,817 | A | | 5/1918 | Kibley et al. |
| 1,574,081 | A | | 2/1926 | Gates |
| 2,171,539 | A | | 9/1939 | Burns |
| 2,645,900 | A | | 7/1953 | Hutchinson |
| 2,654,914 | A | | 9/1953 | Joy |
| 2,699,154 | A | | 1/1955 | Smith |
| 2,729,942 | A | | 1/1956 | Billings et al. |
| 2,838,910 | A | | 6/1958 | Bacchi |
| 2,982,100 | A | | 5/1961 | Sinclair |
| 3,479,958 | A | * | 11/1969 | Anderson et al. ..... 417/437 |
| 4,320,799 | A | | 3/1982 | Gilbertson |
| 4,431,052 | A | | 2/1984 | James |
| 4,448,110 | A | | 5/1984 | Polak et al. |
| 4,480,685 | A | | 11/1984 | Gilbertson |
| 4,490,097 | A | | 12/1984 | Gilbertson |
| 4,637,459 | A | | 1/1987 | Roussel |
| 4,646,517 | A | | 3/1987 | Wright |
| 4,669,536 | A | | 6/1987 | Ames et al. |
| 4,968,226 | A | * | 11/1990 | Brewer ..... 417/435 |
| 5,832,727 | A | * | 11/1998 | Stanley ..... 60/372 |
| 5,996,688 | A | | 12/1999 | Schultz et al. |
| 6,497,281 | B2 | | 12/2002 | Vann |
| 2005/0226752 | A1 | | 10/2005 | Brown |
| 2007/0154324 | A1 | * | 7/2007 | Williams ..... 417/53 |
| 2010/0003150 | A1 | * | 1/2010 | Williams et al. ..... 417/460 |

* cited by examiner

*Primary Examiner* — Devon C Kramer
*Assistant Examiner* — Leonard Weinstein
(74) *Attorney, Agent, or Firm* — Gable Gotwals

(57) ABSTRACT

A reciprocated pump positioned at the lower end of a string of tubing in a bore hole that provides a passageway for moving formation fluid to the earth's surface, including a pump barrel supported in communication with the tubing and a standing valve at the lower end thereof providing a first passageway through which formation fluid flows into the pump barrel, the pump barrel having an intermediate vent port providing a second entry passageway, and a tubular plunger reciprocated within the barrel and having an upper and a lower portion with a plurality of non-metallic seal rings separated by metallic spacers received on the plunger upper portion and configured to support a column of formation fluid within the tubing to substantially isolate the portion of the barrel below the non-metallic seal rings from the tubing pressure to thereby allow formation fluid to move into the pump barrel.

15 Claims, 5 Drawing Sheets

RECIPROCATED PUMP SYSTEM FOR USE IN OIL WELLS

REFERENCE TO PENDING APPLICATIONS

This application is a continuation-in-part application which claims priority to U.S. patent application Ser. No. 11/103,067, filed on Apr. 11, 2005, and entitled "Improved Hydraulic Pump Jack System For Reciprocating Oil Well Sucker Rods".

REFERENCE TO MICROFICHE APPENDIX

This application is not referenced in any microfiche appendix.

FIELD OF THE INVENTION

This invention relates to a system for reciprocating an oil well pump located in the bottom portion of a string of tubing in which the pump is reciprocated by sucker rods extending from the pump to the earth's surface, and an improved reciprocated pump for use in oil wells.

BACKGROUND OF THE INVENTION

Oil wells typically vary in depth from a few hundred, feet to several thousand feet. In many wells there is insufficient subterranean pressure to force the oil to the earth's surface. For this reason some system must be devised for pumping the crude oil from the producing formation to the earth's surface. The most common system for pumping an oil well is by the installation of a pumping unit at the earth's surface that vertically reciprocates a string of sucker rods extending within tubing to a subsurface pump.

Traditionally sucker rod strings have been reciprocated by a device known as a pump jack which operates by the rotation of an eccentric crank driven by a prime mover which may be an engine or an electric motor. Such mechanical drive mechanism has been utilized extensively in oil production industry for decades and continues to be a primary method for extracting oil from a well. However, such mechanical systems suffer from a number of inherent disadvantages or inefficiencies that include their substantial size and weight that makes them expensive to produce, difficult to transport and expensive to install. The mass of such units also requires significant structural support elements at the wellhead which adds to the complexity and expense of the overall drive mechanism. Furthermore, mechanical drive systems have components that are physically linked or connected in some form by way of connecting rods, cams and gear boxes. For a variety of different reasons it often becomes necessary to adjust the travel of the pump rod. Mechanical linkages, as have been previously used, present difficulties in adjusting the travel or displacement of the pumping rods. With most mechanical pumping systems in present use adjusting the rod displacement or pumping speed requires the drive system to be shut down, wasting valuable production time and increasing labor costs. Mechanical drive pump jacks are also limited in their ability to control acceleration and deceleration of the pump rod during its reciprocation.

To combat these limitations in mechanical pump jack drive systems, others have provided a variety of different pneumatic and hydraulic drive mechanisms that have met varying degrees of success. Most hydraulic drive systems in use today are mounted above a stuffing box through which a polished rod extends. Below the stuffing box is a T-fitting so that produced oil is diverted from upward flow within the well tubing to a gathering line that connects to the stuffing box. Stuffing boxes require frequent lubrication. If not constantly lubricated, the packing in stuffing boxes soon wear out resulting in leakage that can spread crude oil to the environment. The invention herein provides an improved hydraulic operated pumping unit that, among other advantages, eliminates the need for a stuffing box.

Another aspect of the present invention is an improved reciprocated pump positioned at the lower end of a string of tubing supported in a borehole, the tubing providing a passageway for moving formation fluid to the earth's surface.

The pump system is formed of a pump barrel positioned in the borehole having an upper and a lower end. The upper end of the pump barrel is in communication with the tubing. A standing valve is positioned adjacent the lower end of the pump barrel and provides a first passageway through which formation fluid flows into the pump barrel.

The pump barrel has an intermediate vent port between the upper and lower ends, the vent port providing a second passageway by which formation fluid enters the barrel.

A tubular plunger is reciprocated within the barrel. The plunger has an upper and a lower end. A traveling valve controls fluid flow through the tubular plunger.

A plurality of individual non-metallic seal rings separated by metallic spacers are positioned on an upper portion of the plunger. The non-metallic seal rings engage the interior cylindrical surface of the pump barrel. The seal rings and metallic spacers are configured to support in substantially leak proof manner the column of formation fluid within the tubing extending to the earth's surface. The non-metallic seal rings and metallic spacers, in sealed relationship with the interior surface of the pump barrel provide a system, that substantially isolates the portion of the barrel below the non-metallic seal rings from the tubing pressure there above to thereby allow formation fluid to more freely flow into the pump barrel. That is, by fully supporting the weight of the produced fluid contained within the tubing extending from the pump barrel to the earth's surface, the area below the packing is thereby substantially at the formation fluid pressure so that no fluid pressure exists within the pump barrel to reduce the rate of fluid flow from the formation into the pump barrel. In this way the pump barrel more rapidly fills on each stroke of the plunger to more efficiently and effectively move formation fluid to the earth's surface as the plunger is reciprocated.

BRIEF SUMMARY OF THE INVENTION

The hydraulic pump jack drive system for reciprocating a down hole oil well pump by means of a sucker rod string, that is the subject of this invention, includes a vertically positioned hydraulic cylinder having a reciprocated piston therein. A cylindrical, polished, piston rod extends from a lower end of the piston and through, a bottom seal that closes the lower end of the hydraulic cylinder. The hydraulic cylinder preferably sits above a wellhead that has the lower end thereof connected to a tubing string that extends from the earth's surface downward to a subterranean oil producing formation. The wellhead has an upper end that is connected to the lower end of the hydraulic cylinder. Further the wellhead includes at least one side orifice that is adapted to be connected to a collection line by which crude oil produced by the well can be conveyed to a collection system. This arrangement eliminates the expense of providing a stuffing box that is typically employed with the systems currently used by the oil industry for pumping reciprocated bottom hole pumps. Not only does the system herein eliminate the stuffing box but eliminates the time and expense encountered in keeping a stuffing box properly lubricated and the packing replaced.

The invention herein provides a hydraulic system in which the stroke action can be significantly varied. By controlling the application of hydraulic fluid pressure the sucker rod strings can be raised at a selected rate from a lower to an upper position. At the upper positions the sucker rod strings may be held briefly in a steady state so that if the bottom hole pump is of the type designed to release gas trapped within the pump, ample opportunity is given for the gas release. Thereafter, the hydraulic system may be controlled so that sucker rod string is dropped rapidly to recharge the bottom hole pump and to restart the pumping cycle.

The present invention addresses and solves many of the problems involved in fluid extraction from oil and gas wells with current art pumping systems. The loss of pump capacity due to rod stretch is eliminated. Full stroke of the pump plunger on each stroke prevents debris accumulating in the normally unused upper section of the pump barrel and therefore allows the pump to be unseated without sticking the plunger in the pump barrel. The repair of pumps is reduced when the plunger and barrel can be reused. Well pulling costs are reduced when the pump can be unseated and the tubing flushed without sticking the plunger in the pump barrel. Well pulling rig costs are reduced due to the ability of the invention to long stroke the pump. When needed the rods can be dropped at a velocity equal to a method only possible in current art pumping systems when a pulling rig is used. The present invention makes possible full control of the reciprocating action of the pump including the ability to stop at the peak of the upstroke or any position in the cycle. The present invention can prevent pipeline damage by adjusting or stopping the rate of the sucker rod fall on the down stroke cycle.

In many wells, and stripper wells in particular, the walking beam pumping system cannot run at a slow enough rate. Well pulling and well tubing, rod and pump repair expense is reduced by slowing the rate to four strokes per minute or less in most wells. Electrical power use and maintenance is reduced. Horse power demand is less and power is only needed on the upstroke of the pump. Elimination of the cyclic load created by a walking beam pumping unit on the electric motor results in reduced power factor penalties from electrical utility companies. In stripper wells in particular which produce ten barrels or less per day, the cost of daily operations are reduced. Reduced risk of pipe line leaks, the elimination of stuffing box leaks and no mechanical maintenance reduces the cost of field equipment and employees required to operate wells.

The present invention provides a pumping system which is easily installed on existing wells and is cheaper to operate and maintain. The productive life of all oil and gas wells depend on the economics involved in extracting and delivering the well bore fluids. The apparatus of the present invention includes (a) a hydraulic cylinder connected to the pumping tee; (b) a pump spacing adaptor attached to the cylinder rod; (c) a sucker rod string attached to the spacing adaptor; (d) a hydraulic pump of pre-determined pressure and rate to raise the rod string and load the down hole pump; (e) a means to control the hydraulic flow at the top of the upstroke of the down hole pump; (f) a means to hold the pump at the top of the stroke for a pre-determined time; (g) a means to release fluid back to the hydraulic reservoir and allow the gravity fall of the sucker rod string; (h) a means to regulate the speed of the gravity tall of the sucker rod string on the down stroke; and (i) a means to restart the pumping cycle at a pre-determined time.

The method of the present invention is an improved method using the above described apparatus for oil and gas well fluid extraction, which comprises, hydraulic fluid pumped into the hydraulic drive cylinder at sufficient pressure to raise the cylinder rod and sucker rod to load the down hole pump. When the pull rod of the down hole pump reaches the maximum stroke length of the pump barrel, pressure increases above what is required to lift the rods. An adjustable pressure switch stops the flow of drive fluid at a pre-determined pressure above the string weight, but less than the pressure required to unseat the pump. This insures full stroke of the pump regardless of the rod stretch. The gas venting pump is held at the peak of the up stroke for a pre-determined time to vent gas out of the fluid chamber and facilitate maximum fluid pump efficiency. After a pre-determined time an adjustable time delay opens a solenoid valve and fluid is allowed to flow from the drive cylinder back to the hydraulic reservoir. Gravity and fluid column pressure in the well tubing allow the rods and pump to return to the down stroke position. A variable orifice valve adjusts the speed of the down stroke by holding back pressure on the drive cylinder. The pressure on the drive cylinder is adjusted to remain above the well tubing pressure with an adjustable back pressure valve. This insures that well fluids cannot dilute hydraulic drive fluid. An adjustable electric time delay restarts the hydraulic pump for the next cycle at a pre-determined time.

Another important advantage of the present invention is the provision of a unique system for adjusting the length of the sucker rod string for more efficient actuation of the bottom hole pump.

Another aspect of the present invention is an improved reciprocated pump positioned at the lower end of a string of tubing supported in a borehole, the tubing providing a passageway for moving formation fluid to the earth's surface.

The pump system includes a pump barrel positioned in the borehole having an upper and a lower end. The upper end of the pump barrel is in communication with the tubing. A standing valve is positioned adjacent the lower end of the pump barrel and provides a first passageway through which formation fluid flows into the barrel.

The pump barrel has an intermediate vent port between the upper and lower ends, the vent port providing a second passageway by which formation fluid enters the barrel.

A tubular plunger is reciprocated within the barrel. The plunger has an upper and a lower end. A traveling valve controls fluid flow through the tubular plunger.

A plurality of individual non-metallic seal rings, separated by metallic spacers, are positioned on the plunger. The non-metallic seal rings engage the interior cylindrical surface of the pump barrel and are configured to support in substantially leak proof manner the column of formation fluid within the tubing extending to the earth's surface. The non-metallic seal rings and metallic spacers in sealed relationship with the interior surface of the pump barrel provide a system that substantially isolates the portion of the barrel below the seal rings from the tubing pressure there above to thereby allow formation fluid to more freely flow into the lower portion of the pump barrel. That is, by the use of packing fully supporting the weight of the produced fluid contained within the tubing extending from the pump barrel to the earth's surface, the area below the packing is thereby substantially at the formation fluid pressure so that no fluid pressure exists within the pump barrel to reduce the rate of fluid flow from the formation into the barrel. In this way the pump barrel more rapidly fills on each stroke of the plunger to more efficiently and effectively move formation fluid to the earth's surface as the plunger is reciprocated.

Further objects and features of the present invention will be apparent to those skilled in the art upon reference to the accompanying drawings and upon reading the following description of the preferred embodiments.

DETAILED DESCRIPTION OF THE PREFERRED EMBODIMENTS

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Elements shown by the drawings are identified by the following numbers:

| | |
|---|---|
| 10 | wellhead |
| 12 | tubing |
| 14 | earth's surface |
| 16 | Tee fitting |
| 18 | top of 16 |
| 20 | hydraulic cylinder |
| 22 | top end |
| 24 | bottom end |
| 26 | piston |
| 28 | internal cylinder wall |
| 30 | downward extending piston rod |
| 32 | seal member |
| 34 | closure member |
| 36 | air vent |
| 38 | hydraulic fluid pump |

-continued

| | |
|---|---|
| 40 | pipe |
| 42 | inlet opening |
| 44 | return pipe |
| 46 | prime mover |
| 47 | battery |
| 50 | hydraulic controls |
| 52 | string of sucker rods |
| 54 | bottom hole pump |
| 56 | side opening |
| 58 | upwardly extending piston rod |
| 60 | upper seal member |
| 62 | tubular adjustment member |
| 64 | reduced diameter lower end |
| 66 | adjustment rod |
| 68 | adjustment nut |
| 70 | coupling |
| 72 | pump barrel |
| 74 | lower end |
| 76 | standing valve |
| 78 | straining nipple |
| 80 | seating shoe |
| 82 | casing |
| 84 | borehole |
| 86 | closed chamber |
| 88 | perforations in the tubing |
| 90 | perforations in the casing |
| 92 | plunger |
| 94 | center tube |
| 96 | connecting tube |
| 98 | coupling nut |
| 100 | metal plunger |
| 102 | valve seat |
| 104 | ball |
| 106 | passageway |
| 108 | elastomeric cups |
| 110 | metallic spacers |
| 112 | coupling nut |
| 114 | upper plunger traveling valve |
| 116 | seat |
| 118 | valve ball |
| 122 | transition coupling |
| 124 | passageways |
| 126 | tube vent ports |
| 128 | barrel vent ports |

Figure 1:
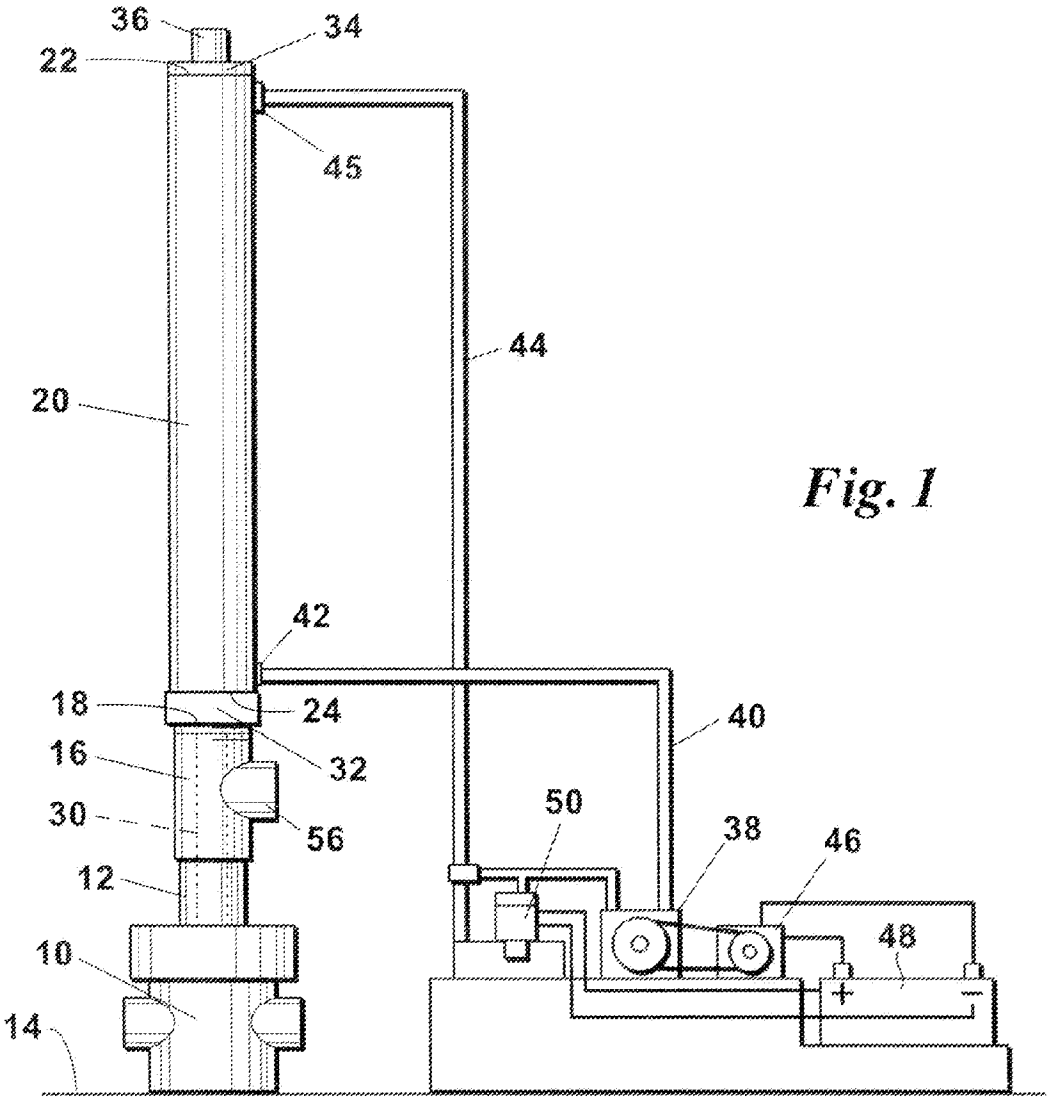
FIG. 1 is an elevational diagrammatic view of a pumping unit according to this invention showing a system for producing hydraulic fluid pressure flow for the actuation of a piston within a cylinder.

Referring to the drawings and first to FIG. 1, the basic elements making up a system that can be used to practice the invention are illustrated. A wellhead 10 of the type that is typically secured to the upper end of oil well casings is illustrated. Extending upwardly from wellhead 10 is the upper end portion of tubing 12. Tubing 12 is typically supported by slips within the wellhead 10, the tubing 12 hanging downwardly in the wellhead and extending down to a producing formation in the earth which may be from several hundred to several thousand feet below the earth's surface 14.

Affixed to the upper end of tubing 12 is a Tee fitting 16 that has a vertical passageway therethrough. Supported on the top 18 of the fee fitting is a vertically positioned elongated hydraulic cylinder 20. Cylinder 20 has a top end 22 and a bottom end 24.

Figure 4:
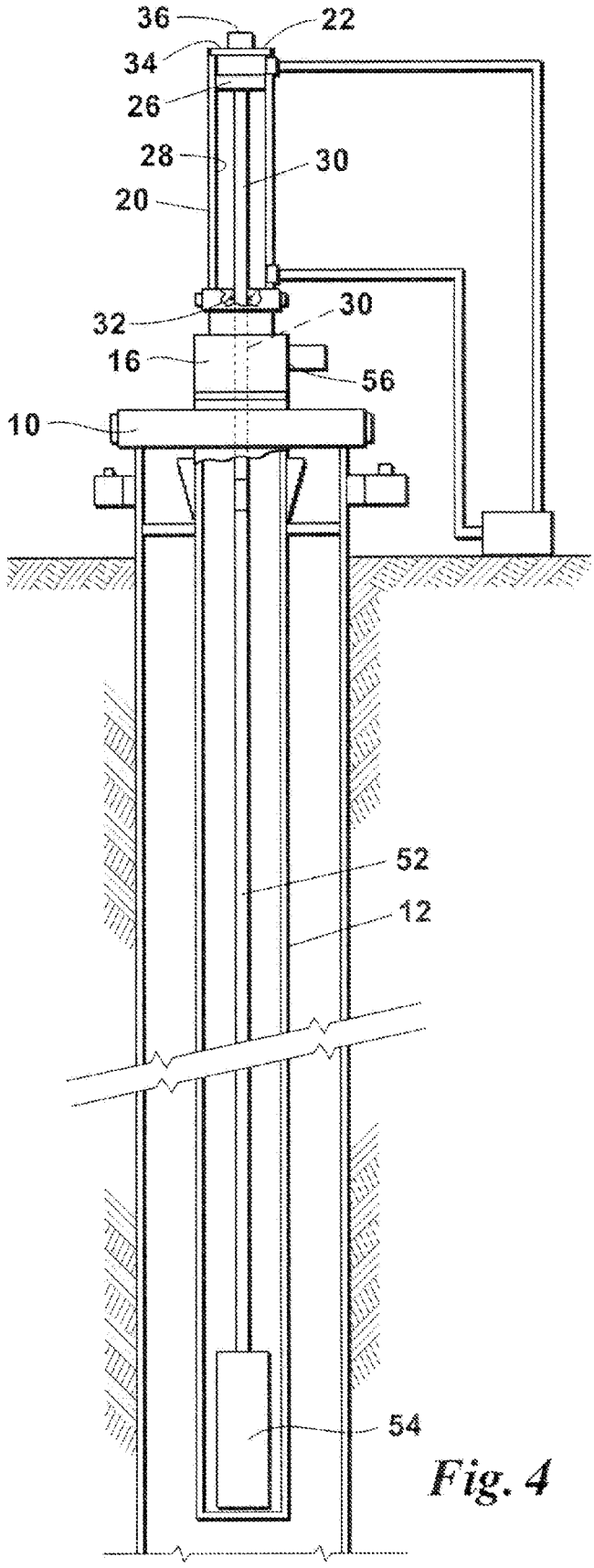
FIG. 4 is an elevational partial cross-sectional view showing diagrammatically the components making up the system of this invention.

FIG. 4 shows hydraulic cylinder 20 in cross-sectional view and shows a piston 26 that is vertically and slidably displaceable within the internal cylindrical wall 28 of hydraulic cylinder 20. Affixed to piston 26 is a vertical, downwardly extending piston rod 30. Piston rod 30 is shown in dotted outline in FIG. 1.

Closing the bottom end 24 of hydraulic cylinder 20 is a seal member 32 that slidably and sealably receives piston rod 30.

The top end 22 of hydraulic cylinder 20 receives a closure member 34 and in the embodiments of FIGS. 1 and 4 closure member 34 has an air vent 36 therein.

As seen in FIG. 1, a hydraulic fluid pump 38 has a high pressure fluid outlet that is connected by pipe 40 to an inlet opening 42 in the cylindrical wall of hydraulic cylinder 20.

Figure 2:
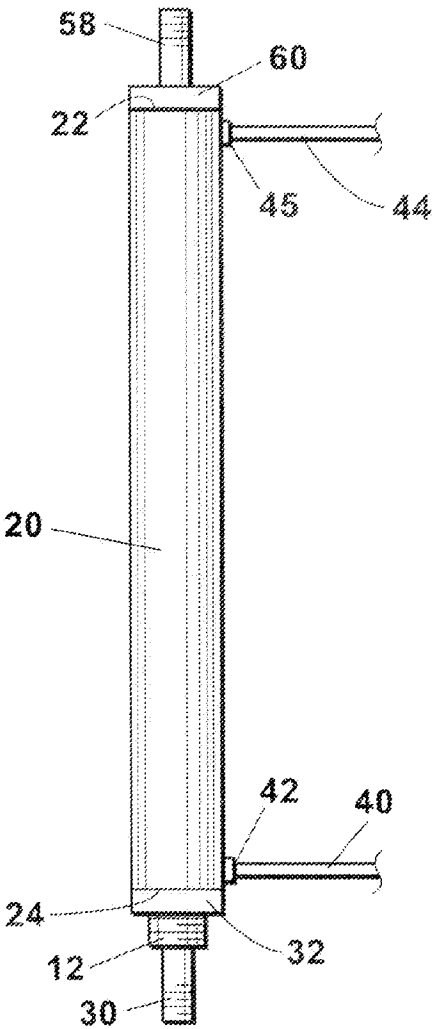
FIG. 2 is an elevational view of the hydraulic cylinder with a piston rod extending therefrom.

Also illustrated in FIG. 1 is an optional return pipe 44 that in the embodiments of FIGS. 1 and 2 connects to an outlet opening 45 in the sidewall of cylinder 20. This permits top member 34 to be closed so that air above piston 26 can be circulated back and forth by the hydraulic fluid pump system 38. However, return pipe 44 is optional since it may be eliminated if closure member 34 has an air vent 36 as illustrated in FIGS. 1 and 2. In an alternate embodiment, as will be discussed with reference to FIG. 4, return pipe 44 connects outlet opening 45 in hydraulic cylinder 20 back to the hydraulic fluid pump 38.

The hydraulic system of FIG. 1 includes a prime mover 46, such as an engine or electric motor, by which pump 38 is powered. If prime mover 46 is a motor, energy may be supplied by way of a battery 48 that is representative of any other kind of electrical energy source. In addition, the hydraulic system includes hydraulic control 50 by which the force of hydraulic fluid applied to move piston 26 (as seen in FIG. 4) is controlled. The importance of the hydraulic control 50 will be described subsequently.

Piston rod 30 extending through seal member 32 is attached to the upper end of a string of sucker rods, generally represented by the numeral 52 in FIG. 4. The lower end of the sucker rod string 52 is secured to a bottom hole pump generally indicated by the numeral 54 in FIG. 4. Sucker rod reciprocated bottom hole pumps are well known in the industry and are used for lifting fluid from a subterranean formation upwardly within tubing 12 to the earth's surface. As the fluid is pumped upwardly from the subterranean formation within tubing 12, it enters into the internal passageway within Tee fitting 16. A side opening 56 in the Tee fitting provides a way of channeling the pumped crude oil to a collection line (not shown) by which the produced crude oil may be conveyed to a storage tank or otherwise passed to systems whereby it is ultimately delivered to a refinery for production of diesel fuel, gasoline, lubricating oils and other derivatives.

The seal member 32 at the lower end of hydraulic cylinder 20 confines the produced crude oil to the interior of Tee fitting 36 and thereby eliminates the requirement for a stuffing box. That is, there is no provision needed to seal around piston rod 30 exterior of the hydraulic cylinder 20.

FIG. 2 shows a different embodiment of the invention in which the hydraulic cylinder 20 has a piston therein (not seen in FIG. 2) that has extending downwardly from it piston rod 30 as has been described with reference to FIGS. 1 and 4 and in addition, there is an upwardly extending piston rod 58. That is, in FIG. 2 the piston has a double extending piston rod arrangement—one extending upwardly and one extending downwardly. In this arrangement, an upper seal member 60 is used at the upper end 22 of hydraulic cylinder 20. In the embodiment of FIG. 2 member 60 that closes the upper end 22 of the hydraulic cylinder 20 is a seal member that slidably and sealably receives an upper extending piston rod 58. When the embodiment of FIG. 2 is employed, hydraulic fluid pressure exists within the cylinder above the piston and therefore a return pipe 44 is required. The double rod piston arrangement of FIG. 2 that includes, in addition to the downward extending piston rod 30, the upwardly extending piston rod 58 is important in a closed hydraulic system since the quantity of hydraulic fluid remains constant during the up and down strokes of the piston.

Figure 3:
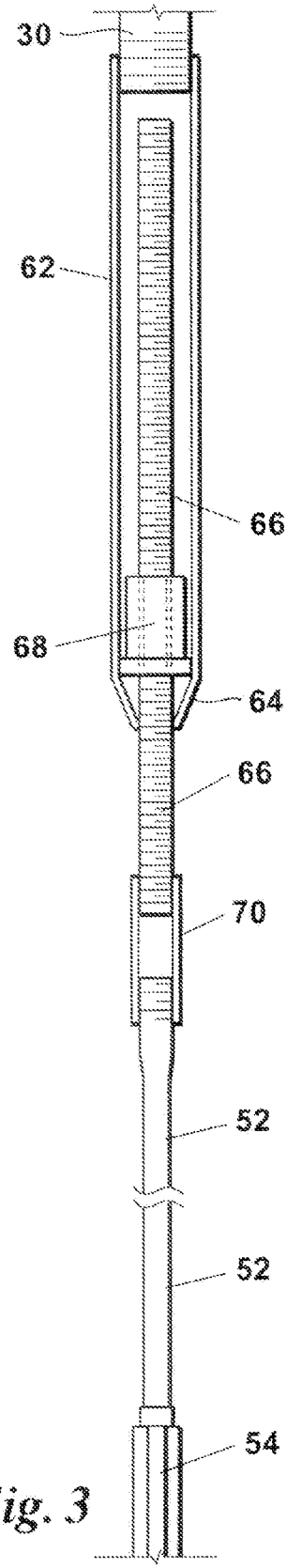
FIG. 3 is an elevational view of the components of the system used to adjust the length of the sucker rod string to more effectively accommodate a bottom hole pump.

It is important that the length of the sucker rod string 52 as seen in FIG. 4 be adjustable for the accurate positioning of bottom hole pump 54. FIG. 3 illustrates a system for adjusting the length of sucker rod string 52.

FIG. 3 shows a vertical tubular adjustment member 62 secured to the lower end of piston rod 30. The tubular adjustment member 62 has a reduced internal diameter open lower end 64 that receives an externally threaded adjustment rod 66. Within tubular adjustment member 62 is an internally threaded adjustment nut 68. By the threadable position of adjustment nut 68 on adjustment rod 66, the effective length of the sucker rod string 52 can be varied. A coupling 70 is threadably attached at the lower end of adjustment rod 62 and to the upper end of sucker rod string 52.

As previously stated, the pumping system of FIG. 1 includes a hydraulic control system 50. This enables the pumping unit to be operated in a manner to make most effective use of the down hole pump 54 that is being employed. For instance, down hole pump 54 may be of a gas release type in which case the hydraulic control system 50 will be regulated so that hydraulic fluid is supplied from hydraulic pump 38 by way of pipe 40 to the lower surface of piston 26 in such a way that the piston is raised at a pre-determined rate of speed which can be relatively constant. The upward movement of piston 26 lifts piston rod 30 and thereby sucker rod string 52 and a plunger (not shown) in bottom hole pump 54, all in an upper direction. When piston 26 reaches the upper end of its stroke as seen in FIG. 4, the hydraulic control system 52 may be regulated such that the piston movement pauses before a downward stroke is commenced. The length of this pause can be adjusted by the system 50. Further, the hydraulic system may be programmed so that the downward movement of piston 26 occurs at a much faster rate than the upward movement. The downward movement rate can be as fast as the fail rate of the sucker rod strings. After the sucker rod string, piston rod and piston have reached their lower downward limit then the upward cycle can begin with or without a delay. Thus, in a preferred way, the pumping cycle applied to bottom hole pump 54 can be carefully regulated to match the requirements of the pump.

Thus, it can be seen that the pumping system herein is more economical than the typical hydraulic pumping system used for reciprocating sucker rod strings in that the need for a stuffing box is eliminated and the need for the constant repair and lubrication of the typical stuffing box is eliminated. Further, the pumping system includes provision for regulating the length of the sucker rod to accurately position the clown hole pump in a well and the pumping cycle of the system can be regulated to match the characteristics of the particular down hole pump being employed.

Figure 5:
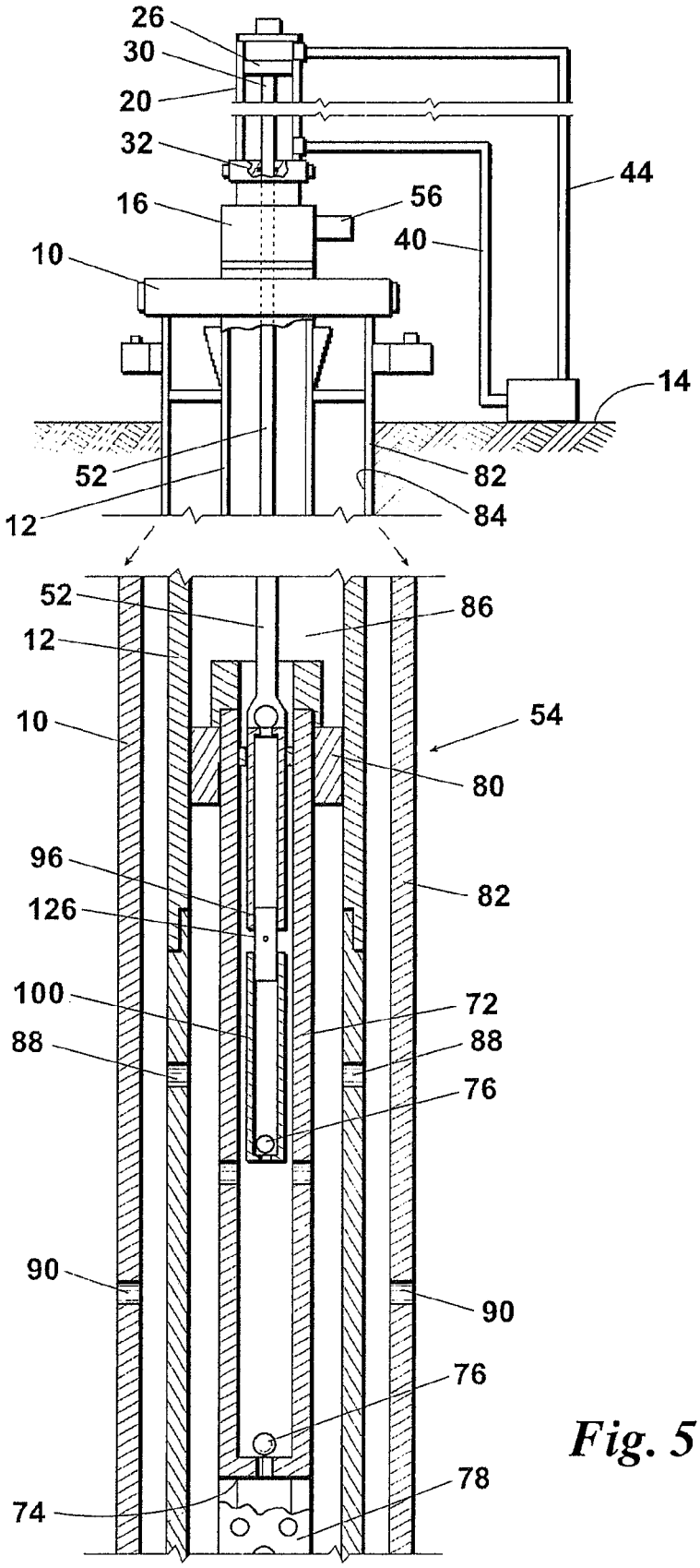
FIG. 5 is a diagrammatic cross-sectional view of the basic elements of a pumping system of this invention having means to facilitate more rapid entry of formation fluid into a pump barrel on each stroke of a pump piston.

An improved, bottom hole pump generally indicated by the numeral 54 is shown diagrammatically in FIG. 5. The improved bottom hole pump includes a pump barrel 72 having, adjacent a lower end 74, a standing valve 76. Typically a straining nipple 78 is fitted to the lower end of the pump barrel. Formation fluid flows through the straining nipple 78 and standing valve 76 into the interior of the pump.

Pump barrel 72 is typically anchored within a lower end portion of tubing 12 by a sealing shoe 80, shown diagrammatically in FIG. 5. Seating shoe 80 seals against the interior of tubing 12 and the exterior of pump barrel 72.

The function of pump 54 is to move production fluid, such as crude oil, from an area within the earth's surface that is penetrated by a borehole that receives casing 82. Casing 82 is received in a borehole that has been drilled into the earth's surface 14 down to porous rock or sand (not seen) that has therein useful fluids, such as crude oil.

Thus the seating shoe 80 supporting pump barrel 72 forms the bottom end of a closed chamber 86 within tubing 12 that extends from pump 54 to the earth's surface. The function of pump 54 is to move fluid from the producing formation into this closed chamber 86 so that fluid therein gradually moves upward to the earth's surface 14 and ultimately out through side opening 56 in Tee fitting 16. Note that tubing 12 is perforated, that is, it has holes therein indicated by the numeral 88. These perforations allow formation fluid to flow from within casing 10 into the interior of tubing 12 below seating shoe 80. Casing 82 in like manner has perforations 90 to allow production fluid to flow therethrough.

Figure 6:
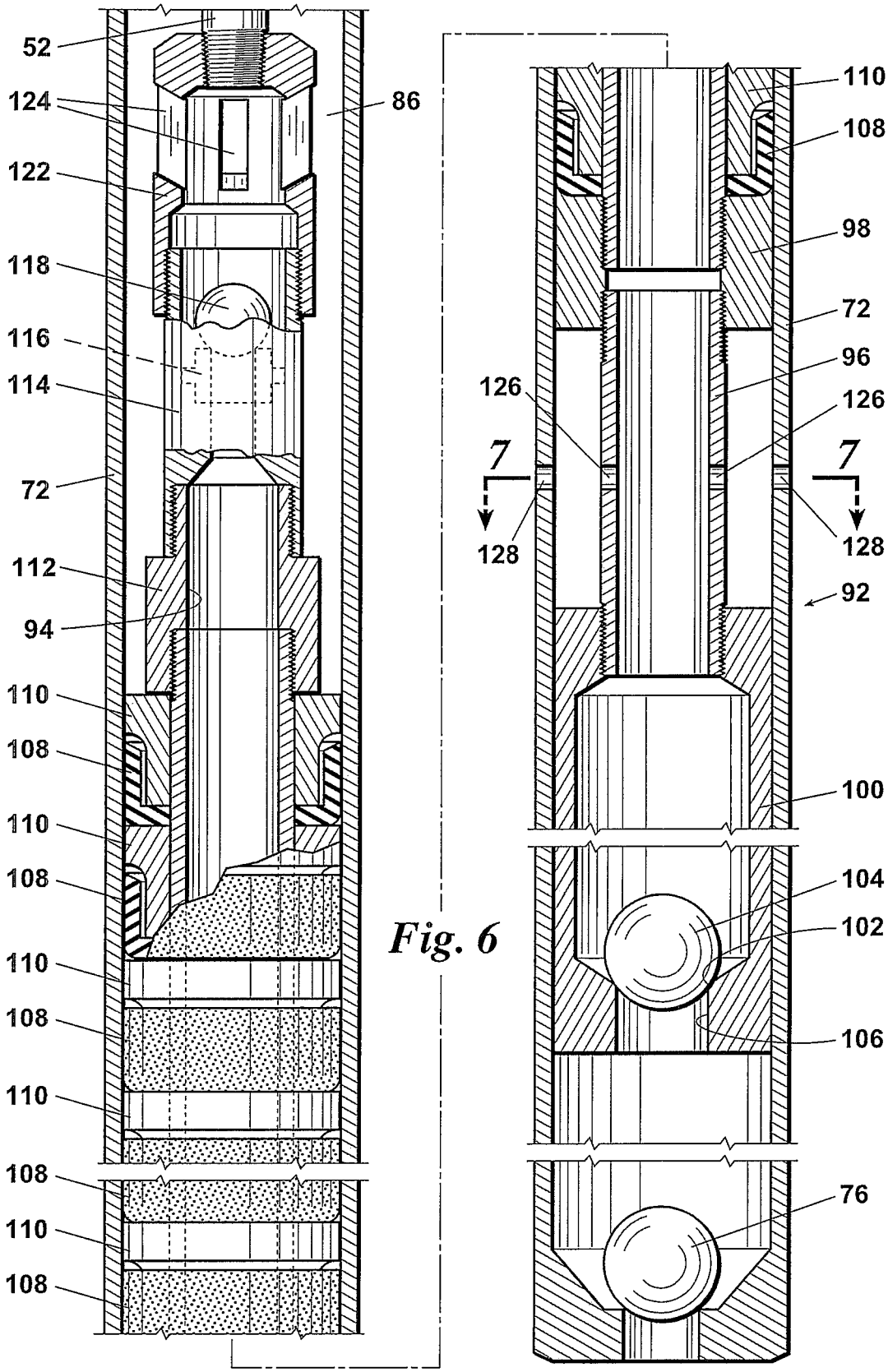
FIG. 6 is an exploded, more detail, view of the improved pumping system of the invention. The illustrated pump has means to fully and completely support a column of fluid extending from the pump to the earth's surface. In this way the fluid column is isolated from the interior of the pump barrel to more effectively and efficiently permit formation fluid flow into the pump barrel on each stroke of the reciprocated pump.

While the bottom hole pump 54 is shown diagrammatically in FIG. 5, FIG. 6 shows more representative details of a typical pump that conforms with the principals of this invention. In FIG. 6 the casing and tubing of the well are not shown and pump barrel 72 is shown with upper and lower portions. Received within pump barrel 72 is a plunger generally indicated by the numeral 92, the plunger also being shown with upper and lower portions. Plunger 92 includes an upper center tube 94 and a connecting tube 96. The tube portions 94 and 96 being in axial alignment and secured end-to-end by a coupling nut 98. Coupling nut 98 is slidably received within pump barrel 72.

Secured to a lower end of connecting tube 96 is an elongated metal plunger 100 that includes a valve seat 102 and a ball 104 that form a lower plunger traveling valve. The lower traveling valve functions, on a down stroke of plunger 92, to permit formation fluid to pass through the valve passageway 106 to enter into the interior of metal plunger 100. The interior of metal plunger 100 communicates with the interior of connecting tube 96 and center tube 94.

Received on the upper center tube 94 are a plurality of alternating elastomeric cups 108 and metallic spacer 110. The exterior diameter of the metallic spacers 110 is slightly less than the interior diameter of pump barrel 72. The elastomeric cups 108 are slightly radially expandable to closely seal against the interior surface of pump barrel 72. This positive sealing contact with the pump barrel serves to support the liquid column within the interior of tubing 12, that is the fluid column formed by closed chamber 86. Thus the liquid column 86 is confined permitting liquid escape from the column only as the liquid is moved upwardly through the tubing to pass out the upper end of the tubing through Tee fitting 16 and side openings 56 as seen in FIG. 5.

The metal plunger portion 100 of the overall plunger 92 is of a length approximately that of the upper portion of the plunger having elastomeric cups 108 and metallic spacers 110. The exact proportional relationship of the length of these two components of pump 54 are not critical. That is, the upper portion of plunger 92 having metallic spacers 110 and the elastomeric cups 108 can be either greater or less than the length of metal plunger 100.

As previously stated the external diameter of metal plunger 100 is substantially equal to but slightly less than the interior diameter of barrel 72. The metal-to-metal relationship between metal plunger 100 and barrel 72 does not need to be a perfectly leak proof relationship since the function of metal plunger 100 is not to support the fluid column extending above the pump to the earth's surface but instead is to provide for fluid displacement within the barrel. The portion of the pump that includes metal plunger 100 is essentially a compression chamber. On a down stroke, the metal plunger 100 displaces the area within the barrel to cause movement of fluid past the traveling valve created by ball 104 and seat 102 and into the interior of the plunger so that the fluid that moves therein is vertically transported upwardly upon an upper stroke of the plunger to the earth's surface. In the illustrated arrangement of FIG. 6, the plunger traveling valve accomplished by ball 104, seat 102 and passageway 106 are shown as being integral to a lower portion of the metal plunger 100. This is by way of illustration only as in the actual practicing of the invention this traveling valve is formed of a separate device that is threaded onto the lower end of metal plunger 100.

As seen in the left hand portion of FIG. 6, the upper end of center tube 94 has attached thereto a coupling nut 112 that provides a surface for the capture of the elastomeric cups 108 and metal spacers 110 in a compressed arrangement. Secured to an upper end of coupling nut 112 is an upper plunger traveling valve 114. This traveling valve includes, as shown in dotted outline, a removable seal 116 and partially in solid outline a valve ball 118. This upper plunger traveling valve 114 permits fluid to flow from within the interior of the plunger upwardly through a transition coupling 122 that, on its lower end is affixed to upper traveling valve 114 and at its upper end to the lower end of sucker rod string 52. This transition coupling has passageway 124 in the sidewall thereof by which fluid flows from the interior of the plunger into the closed chamber 86. The seating shoe 80 shown on the exterior of pump barrel 72 in FIG. 5 is not shown in FIG. 6. This seating shoe 80 connects the pump barrel to the interior of the tubing so that fluid pumped out the upper end of the pump barrel through passageways 124 enters into the lower end of the tubing for transfer upwardly through the tubing to the earth's surface.

An important aspect of this invention is illustrated in the right hand portion of FIG. 6. This is the provision of vent ports 126 in connecting tube 96. These vent ports 126 function in cooperation with barrel vent ports 128. As previously stated, with respect to FIG. 5, pump barrel 72 is primarily filled with formation fluid by fluid flow through straining nipple 78 and standing valve 76 into the interior of pump barrel 72. On the downward stroke of plunger 92 this production fluid flows into the interior of the plunger through traveling valve 102, 104. On the upward stroke of the plunger, traveling valve 104 closes so that fluid captured in the pump barrel 72 and within the interior of plunger 92 is moved out the upper end of the barrel and into the closed chamber 86 that is in communication with the lower end of tubing 12 as seen in FIG. 5.

To provide a supplemental passageway for production fluid to enter pump barrel 72 and ultimately into the interior of plunger 92, barrel vent ports 128 are provided.

Figure 7:
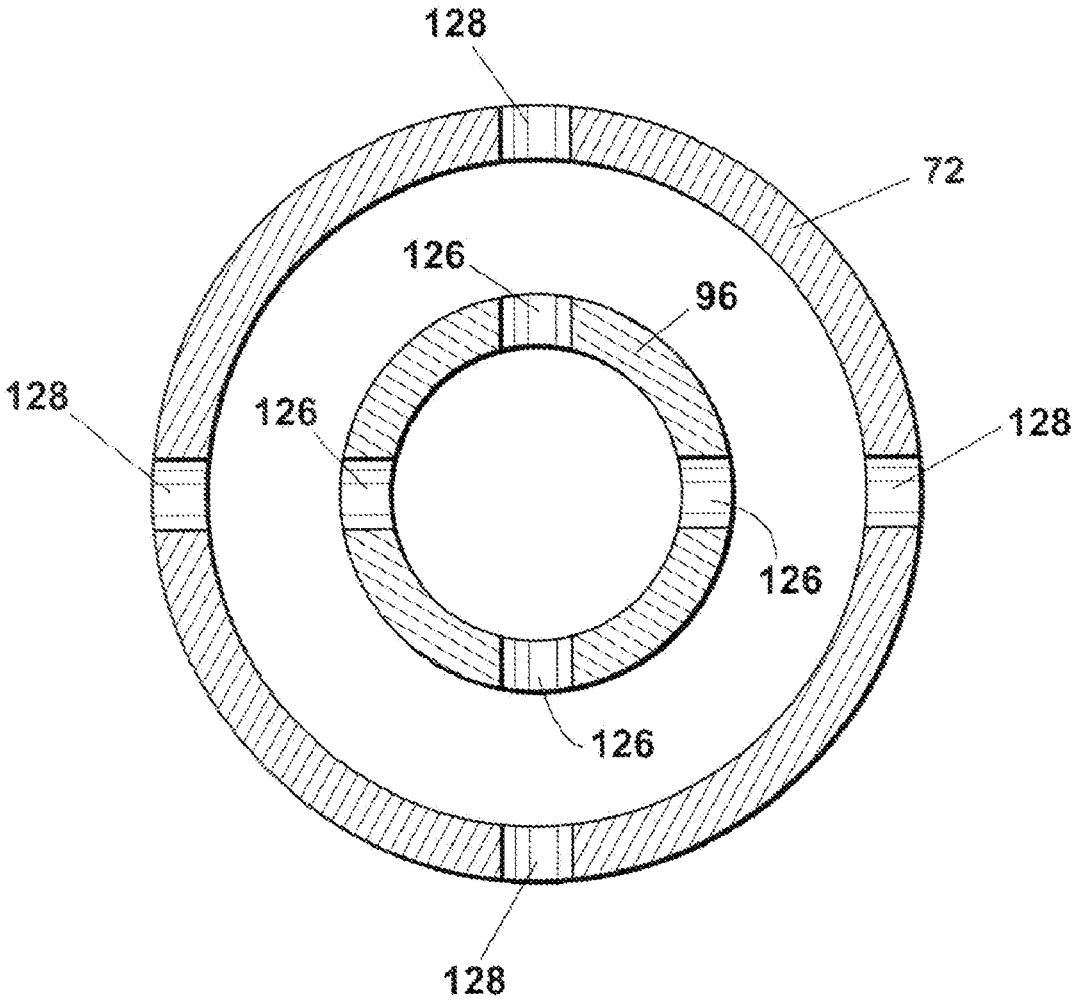
FIG. 7 is an enlarged cross-sectional view taken along the line 4-4 of FIG. 6 showing perforations in the pump barrel that allows flow of formation fluid into the interior of the pump barrel. Further, this view shows perforations in the pump tubular plunger which allows fluid flow into the interior of the plunger. After entering into the interior of the tubular plunger fluid is forced out of the traveling valve at the upper end of the plunger and into the interior of the tubing for ultimate transportation to the earth's surface.

FIG. 7 is a horizontal view taken along the line 4-4 of the right hand portion of the pump shown in FIG. 6 and shows the tube vent ports 126 and the barrel vent ports 128 in the same plane. This relationship of tube vent ports 126 and barrel vent ports 128 occurs instantaneously on each upstroke and down stroke of the plunger and preferably at or adjacent to the upward end of the upstroke of the pump plunger. In this relative position of the plunger in the pump barrel additional production fluid can flow from the interior of the barrel into the interior of the plunger and simultaneously production fluid can flow from the formation into the interior of the barrel so as to more expeditiously supply fluid to the interior of the plunger to be upwardly moved into the interior of the tubing for transportation to the earth's surface.

In order for the pump barrel and the pump plunger to most expeditiously fill on the upward stroke of the pump plunger it is important that the pressure within the pump barrel below the plunger does not exceed the pressure of the fluid surrounding the pump barrel, that is, the formation fluid pressure. Obviously if the pressure inside the barrel and the plunger are greater than that outside the barrel and the plunger, then fluid will not flow into these areas. Therefore, it is important and a critically unique feature of the present invention to maintain fluid pressure within the plunger and within the barrel as low as possible for more rapid filling of the pump. The pressure within the barrel and within the plunger is materially affected by any pressure leakage within the barrel in response to the fluid pressure above the pump plunger. That is, the pump plunger must fit the barrel with such precision that the high fluid pressure of the fluid column within the tubing, which pressure rests upon the fluid within the upper end of the pump piston, is not permitted to leak past the upper portion of the pump plunger. For this reason an important aspect of the present invention is the provision of the pump plunger having two distinct portions, that is, an upper portion that has on the plunger external surface a plurality of spaced apart elastomeric cups 108 supported in position by metallic spacers 110. The metallic spacers 110 are arranged to support the cups 108 but nevertheless allow the cups to radially expand outwardly into sealing contact with the internal cylindrical surface of the pump barrel. Thus as the pressure of fluid within the tubing extending from the pump to the earth's surface is increased, the force tending to outwardly radially expand the elastomeric cups increases to thereby prevent or at least substantially reduce leakage of fluid from the tubing into the interior of the pump barrel.

A typical bottom hole pump is reciprocated several times per minute in the process of pumping oil to the earth's surface. Each reciprocation of the pump plunger moves only a small quantity of formation fluid into the barrel and upwardly into the column of fluid within the tubing. Therefore any increase in the amount of fluid moved with each stroke of the pump is significant. If a well is pumped for several hours the number of strokes pumped becomes a large significant number and if each stroke of the pump produces only a small increase in the quantity of fluid lifted then the end result becomes very significant. The present invention improves pumping efficiency in two ways. First, a pump is provided having a plunger with two distinct areas, that is, an upper portion and a lower portion and in which the upper portion is provided with elastomeric cups to more effectively seal against the internal wall of the pump barrel and prevent leakage of fluid and pressure of the fluid column within the tubing from communicating with the lower portion of the pump barrel. The second improvement is the provision for more rapidly and efficiently filling the barrel and the pump plunger on each stroke of the pump.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A pumping system comprising:

a hydraulic cylinder being vertically oriented and elongated and housing a fluid pressure and a piston, said piston being vertically displaceable and having a piston rod extending beyond a bottom end of said hydraulic cylinder and being in communication with a sucker rod string;

a controlled hydraulic power system providing fluid pressure to said hydraulic cylinder to vertically reciprocate said piston and therefore the sucker rod string;

a tee fitting having an upper end secured to said bottom end of said hydraulic cylinder and a lower end secured to a well tubing, said piston rod passing through a vertical passageway of said tee fitting;

a seal member located entirely within said hydraulic cylinder and sealably receiving said piston rod and having an upper surface sealing said bottom end of said hydraulic cylinder and having a lower surface in communication with a well fluid and confining the well fluid to an interior of said tee fitting; and a vertically reciprocal pump including:

a pump barrel having a standing valve at a lower end thereof and a pump barrel vent port spaced above the standing valve;

a pump plunger positioned within said pump barrel and adapted for reciprocation by said sucker rod string, said pump plunger having an upper plunger portion and a lower plunger portion and a pump plunger vent port located between said upper and lower plunger portions;

said upper plunger portion having a plurality of non-metallic wiper rings sealably engaging said pump barrel;

reciprocation of said pump plunger resulting in a fluid column within the tubing continually being supported by the plurality of non-metallic wiper rings of said upper plunger portion;

said pump barrel vent port in combination with said pump plunger vent port and said lower plunger portion equalizing with a fluid pressure of the well fluid at the lowest setting depth of said vertically reciprocal pump in a well bore and permitting said pump barrel to fill independent of a stroke rate and suck in the well fluid on an upstroke of said vertically reciprocal pump.

2. A pumping system according to claim 1 further comprising a top end of said hydraulic cylinder being vented to the atmosphere.

3. A pumping system according to claim 1 further comprising:

a top seal affixed to a top end of said hydraulic cylinder;

an upper piston rod affixed to said piston and extending beyond said top end and sealably and reciprocally received by said top seal; and said controlled hydraulic power system provides controlled fluid flow to said hydraulic cylinder above and below said piston.

4. A pumping system according to claim 1 further comprising said controlled hydraulic power system is programmable permitting separate selectable upward and downward acceleration rates of the sucker rod string.

5. A pumping system according to claim 4 further comprising said controlled hydraulic power system includes a program providing selectable delays during at least one of a top reciprocation and a bottom reciprocation of the sucker rod string.

6. A pumping system according to claim 1 further comprising a sucker rod length adjustment mechanism between said piston rod and the sucker rod string.

7. A pumping system according to claim 6 further comprising said sucker rod length adjustment mechanism including:

a vertical tubular adjustment member affixed at an upper end to said piston rod and having a reduced internal diameter open lower end;

an externally threaded adjustment rod having an upper end portion received within said vertical tubular adjustment member and a lower end affixed to the sucker rod string; and an internally threaded adjustment nut threadably received on said externally threaded adjustment rod within said vertical tubular adjustment member, the length of the sucker rod string being adjustable by rotational position of said internally threaded adjustment nut.

8. A pumping system according to claim 1 further comprising said vertically reciprocal pump having a traveling valve attached to a bottom end of said lower plunger portion.

9. A pumping system according to claim 1 further comprising said controlled hydraulic power system allowing the sucker rod string to fall by gravity during a downward reciprocation of the sucker rod string.

10. A pumping system according to claim 1 further comprising said controlled hydraulic power system holding said upper plunger portion in a position above said pump barrel vent port.

11. A pumping system according to claim 10 further comprising the pump plunger when held in the position above said pump barrel vent port providing a pump barrel pressure equal to a pressure of the well fluid.

12. A pumping system according to claim 10 further comprising said controlled hydraulic power system holding an upward reciprocation of the sucker rod string at a peak of the upward reciprocation.

13. A pumping system according to claim 1 further comprising a top end of said hydraulic cylinder being connected to a return line of said controlled hydraulic power system.

14. A pumping system according to claim 1 further comprising said hydraulic cylinder being of a length that allows said piston to travel a distance needed to insure full displacement of said vertical reciprocal pump during an upstroke and a downstroke reciprocation of the sucker rod string.

15. A pumping system according to claim 1 further comprising said controlled hydraulic power system providing a sufficient pressure applied under said piston to unseat said vertically reciprocal pump.

* * * * *